US005683317A

United States Patent [19]

Walker et al.

[11] Patent Number: 5,683,317

[45] Date of Patent: Nov. 4, 1997

[54] AUTOMATED LACING FOR SOFTBALLS AND BASEBALLS

[75] Inventors: Alan Walker, Somers, Conn.; Ron LaLiberty, Dudley; Joseph Stahl, Southampton, both of Mass.

[73] Assignee: Lisco, Inc., Tampa, Fla.

[21] Appl. No.: 497,568

[22] Filed: Jun. 30, 1995

[51] Int. Cl.[6] ..... A63B 37/12

[52] U.S. Cl. ..... 473/600; 473/598

[58] Field of Search ..... 273/60 R, 60 A, 273/61 R, 61 B, 65 E, 58 A, 58 K; 473/598, 600, 607, 608

[56] References Cited

U.S. PATENT DOCUMENTS 3,099,147 7/1963 Fossa ..... 69/8
3,151,584 10/1964 Fossa ..... 112/2
3,178,917 4/1965 Fossa ..... 69/21
3,976,295 8/1976 Heald, Jr. ..... 273/60 R
4,261,565 4/1981 Massino, Sr. ..... 273/60 R
4,880,233 11/1989 Song ..... 273/60 R

*Primary Examiner*—Steven B. Wong

[57] ABSTRACT

A system and method for fabricating a ball comprising the steps of supporting a spherical core with unlaced covers thereover. Rotating the core upon a first axis to move a portion of the covers through a lacing zone. Lacing the portion of the cover moved through the lacing zone. Rotating the core upon a second axis to move an additional portion of the cover through the lacing zone. Lacing the additional portion of the cover moved through the lacing zone.

3 Claims, 12 Drawing Sheets

FIG. 1
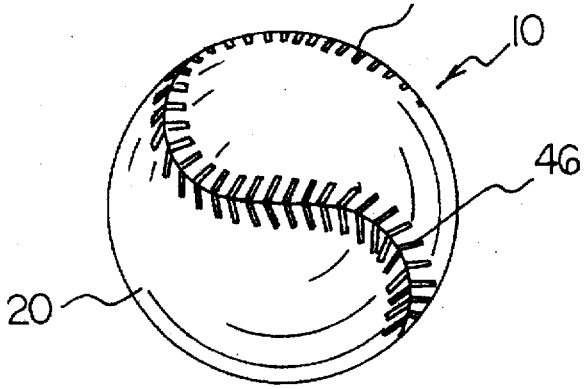
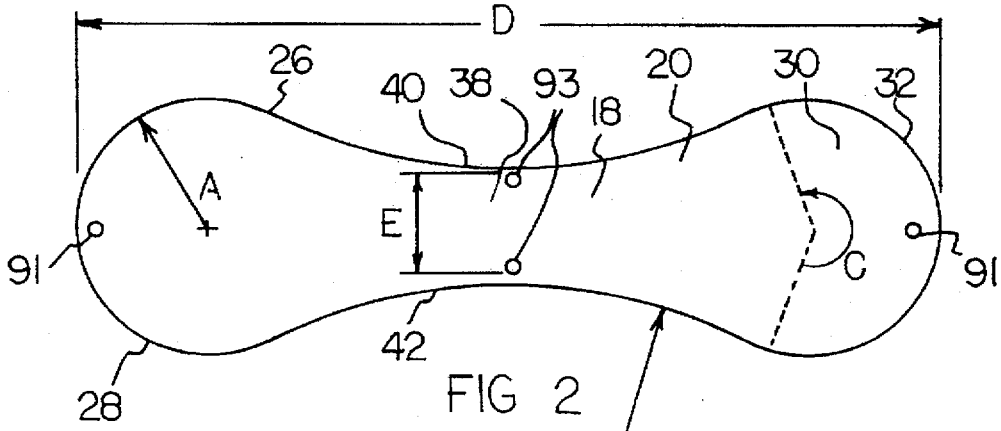
FIG 2
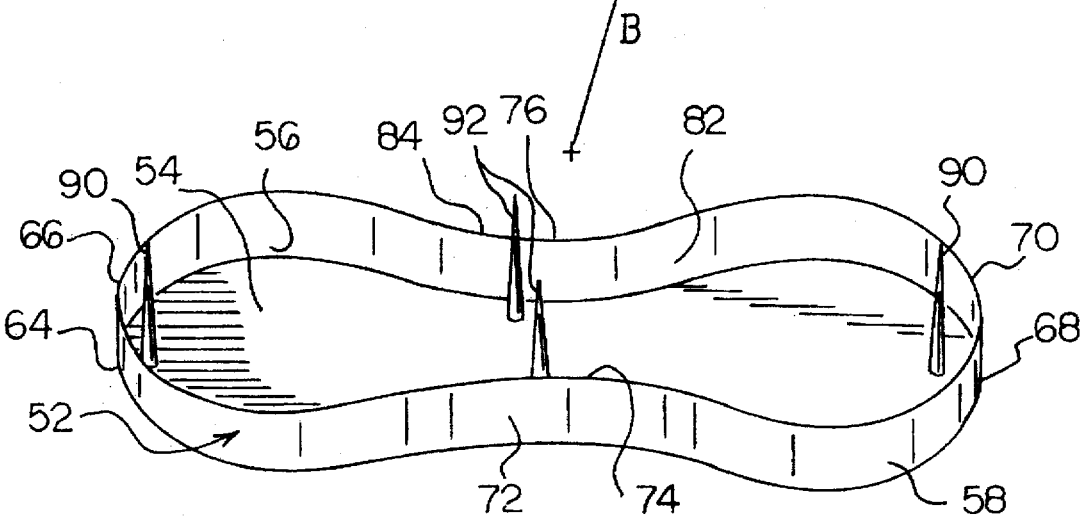
FIG 3

304
340
330
332
324
320
322
324
352
314

342
344
346
338
346

340
330
332
324
320
322
324
352
314

342
344
346
338
346

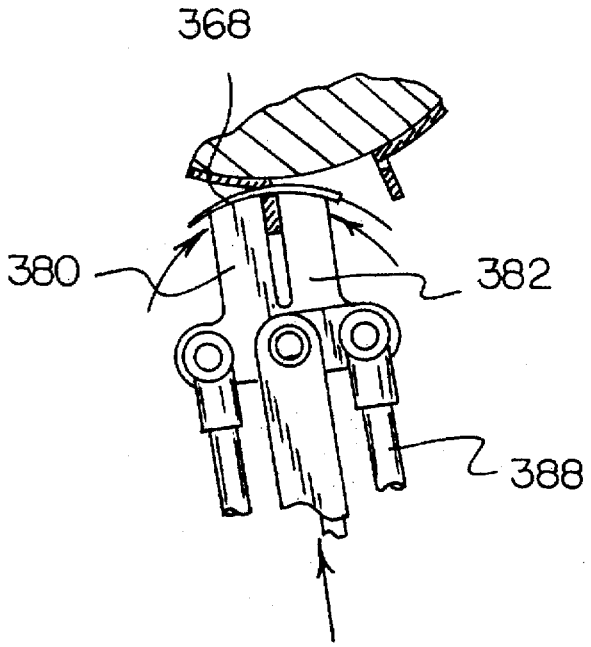
FIG 24
FIG 25
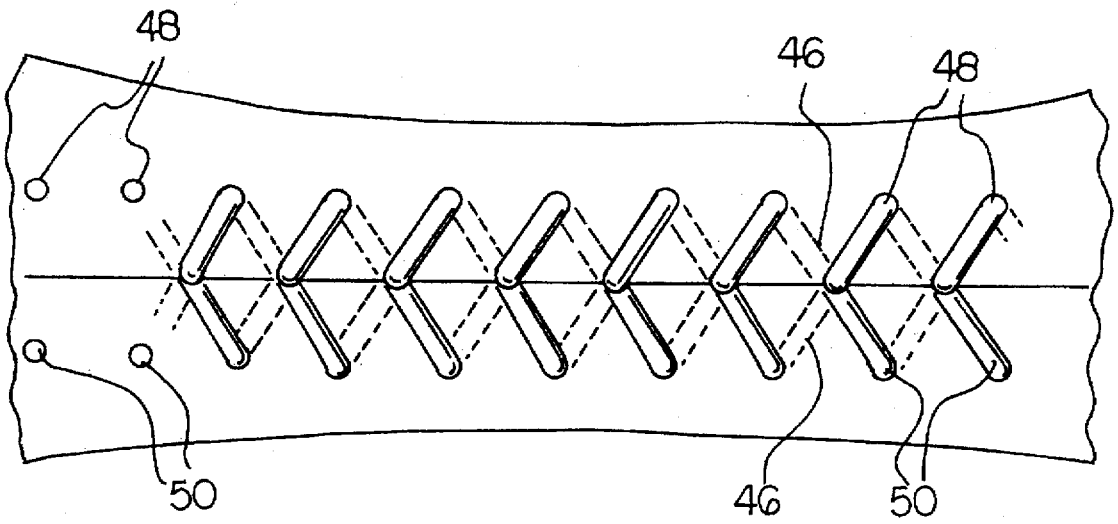

FIG 27
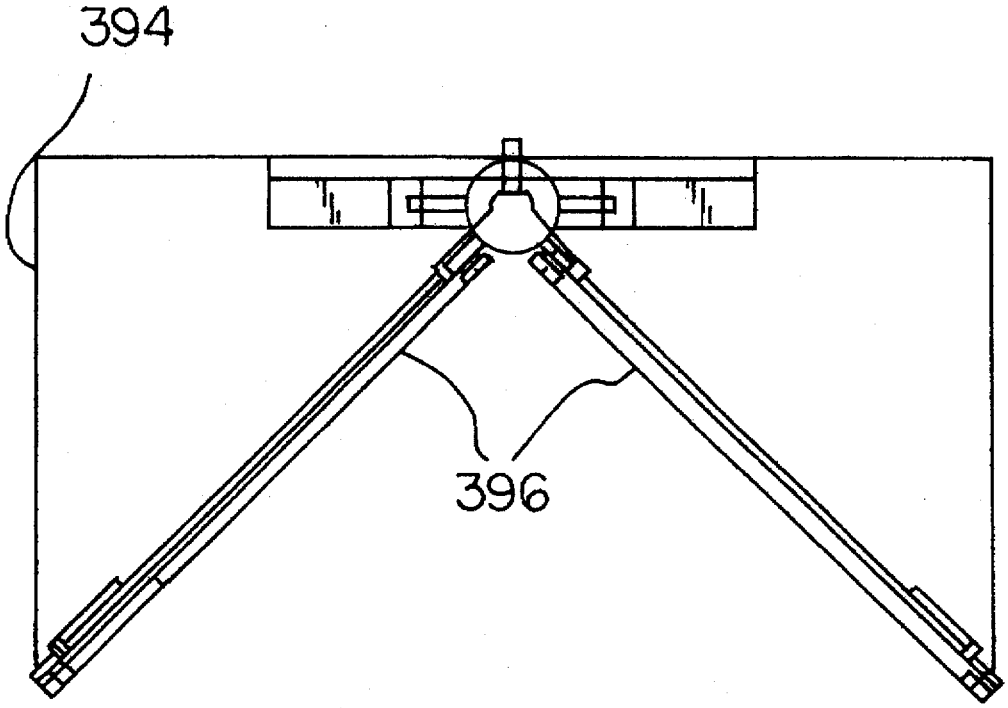
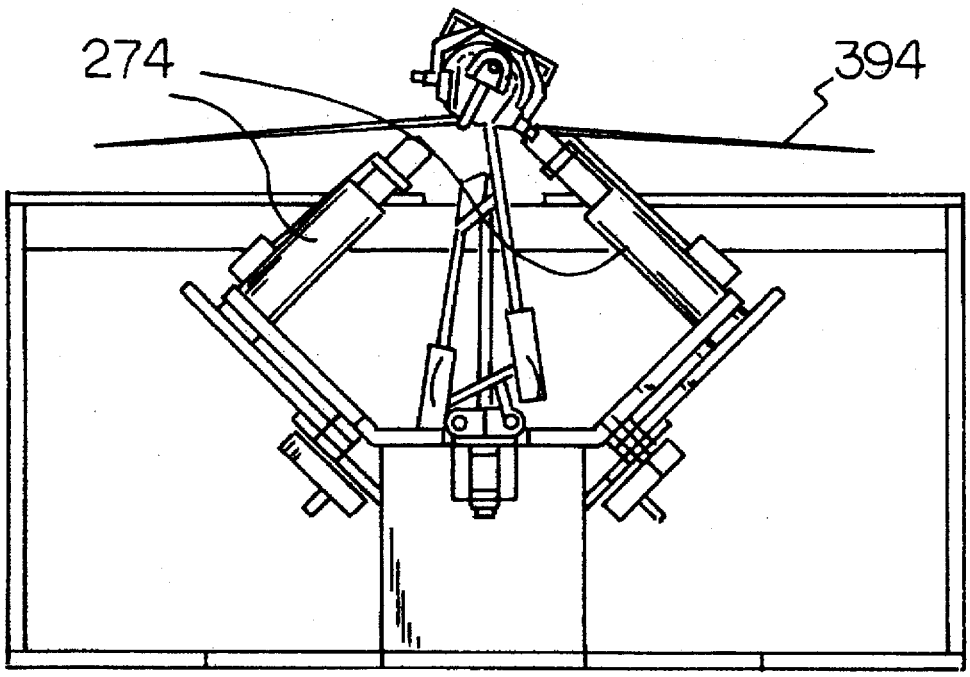
FIG 26

AUTOMATED LACING FOR SOFTBALLS AND BASEBALLS

BACKGROUND OF THE INVENTION

1. Field of the Invention

This invention relates to automated lacing of softballs and baseballs and, more particularly, to a method and apparatus for automatically covering the core of a ball.

2. Description of the Background Art

Many types of devices have been devised in an effort to automatically apply cover panels to the core of a softball or a baseball. No such effort has been successful, and even to this day, all covers for softballs and baseballs are applied manually.

Typical examples of technical efforts to automate the fabrication of softballs and baseballs are described in the patent literature. Note for example, the following patents issued to Joseph Fossa: U.S. Pat. No. 3,099,147 entitled Apparatus for Preparing Baseball Cover Pieces for Sewing; U.S. Pat. No. 3,151,584 entitled Sewing Clamp Assemblies; and U.S. Pat. No. 3,178,917 entitled Machines and Methods for Spheriphying Baseball Cover Pieces on Baseball Cores. No prior effort has been found to be sufficiently successful to replace the presently utilized hand operation.

Accordingly, it is an object of the present invention to automatically cover softballs and baseballs.

A further object of the present invention is to configure the panels for softballs and baseballs so as they may be adapted to an automated process.

A further object of the present invention is to overcome the encumbrances found in the prior art efforts to automate the fabrication of softballs and baseballs.

It is a further object of the present invention to provide a system and method for fabricating a ball comprising the steps of supporting a spherical core with unlaced covers thereover; rotating the core upon a first axis to move a portion of the covers through a lacing zone; lacing the portion of the cover moved through the lacing zone; rotating the core upon a second axis to move an additional portion of the cover through the lacing zone; lacing the additional portion of the cover moved through the lacing zone; repeating the rotating and lacing steps to complete the lacing operation.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention many be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into a system for fabricating a ball comprising, in combination, (a) a spherical core; (b) a pair of dumbbell-shaped panels with convex end edges and with a concave central extent therebetween; (c) a first clamping assembly; (d) a first lasting holder for positioning therein a first clamping assembly, a first panel, and a core; (e) means for shaping the first panel around a first portion of the core and clamping the first panel in position with the first clamping assembly; (f) means for providing a second lasting holder for positioning therein a second clamping assembly, a second panel and the partially lasted core; (g) means for shaping the second panel around the remainder of the partially lasted core and clamping the second panel in position on the core; (n) an indexing drive with two support arms, each support arm adapted to receive and support a portion of a clamping assembly; (i) means for grasping a portion of the first clamping assembly by the first support arm; (j) means for rotating one indexing drive, support arm, clamping assembly and supported core whereby one-fourth of the line between adjacent panels will move through an operational zone; (k) means for punching lacing holes through the panels adjacent to their peripheries as they move through the operational zone; (l) means for grasping a portion of the second clamping assembly by the second support arm and releasing the first portion of the first clamping assembly by the first support arm; (m) means for rotating the second indexing drive, support arm, clamping assembly and supported core whereby another one-fourth of the line between adjacent panels will move through the operational zone; (n) means for punching lacing holes through the panels adjacent to their peripheries as they move through the operational zone; (o) repeating steps i, j, k, l, m and n to thereby punch lacing holes in the entire lasted core; (p) means for grasping a portion of the first clamping assembly by the first support arm; (q) means for rotating one indexing drive, support arm, clamping assembly and supported lasted core whereby one-fourth of the line between adjacent panels will again move through the operational zone; (r) means for moving lacing through the holes as they move through the operational zone; (s) means for grasping a portion of the second clamping assembly by the second support arm and releasing the first portion of the first clamping assembly by the first support arm; (t) means for rotating the second indexing drive, support arm, clamping assembly and supported core whereby another one-fourth of the line between adjacent panels will again move through the operational zone; (u) means for moving lacing through the holes as they move through the operational zone; (v) means for repeating steps p, q, r, s, t and u to thereby move lacing through holes in essentially the entire lasted core.

The foregoing has outlined rather broadly, the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which:

FIG. 1 is a front elevational view of a ball constructed in accordance with the principles of the present invention.

FIG. 2 is a plan view of one of the panels used in covering the ball.

FIG. 3 is a die for fabrication of the panels.

FIGS. 18 through 24 are front elevational views of the lacing apparatus showing the sequence of operations.

FIG. 25 is a schematic illustration showing the lacing sequence with one end of the lace in dotted lines and the other in dashed lines.

FIGS. 26 and 27 are a front view and a plan view of the lace tightening apparatus.

Similar reference numerals refer to similar parts throughout the several Figures.

DETAILED DESCRIPTION OF THE PREFERRED EMBODIMENTS OVERVIEW

Figure 4:
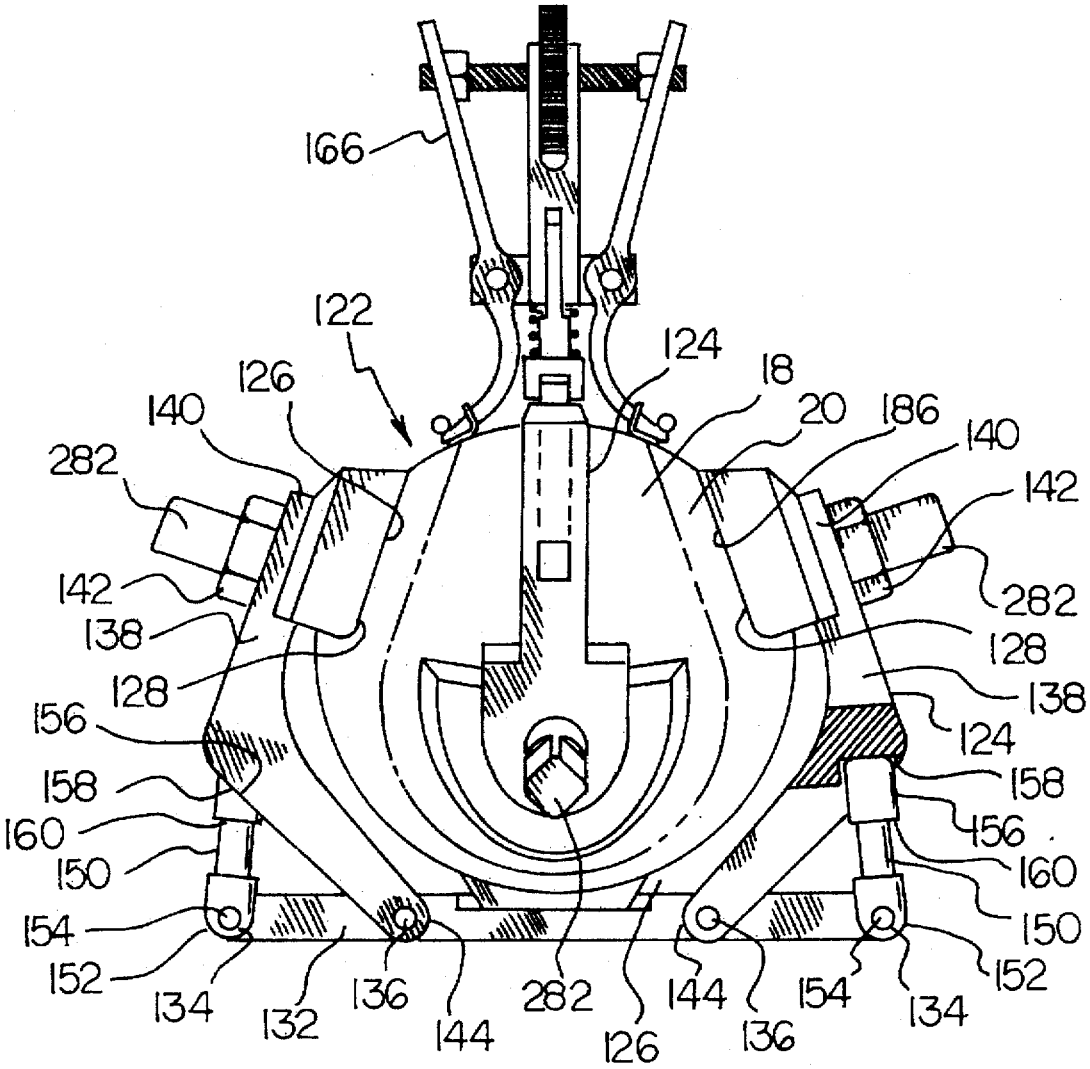
FIG. 4 is a front elevational view of a ball with a cover supported thereon and also including two clamping mechanisms and a tightening mechanism utilized during the fabrication process.
Figure 5:
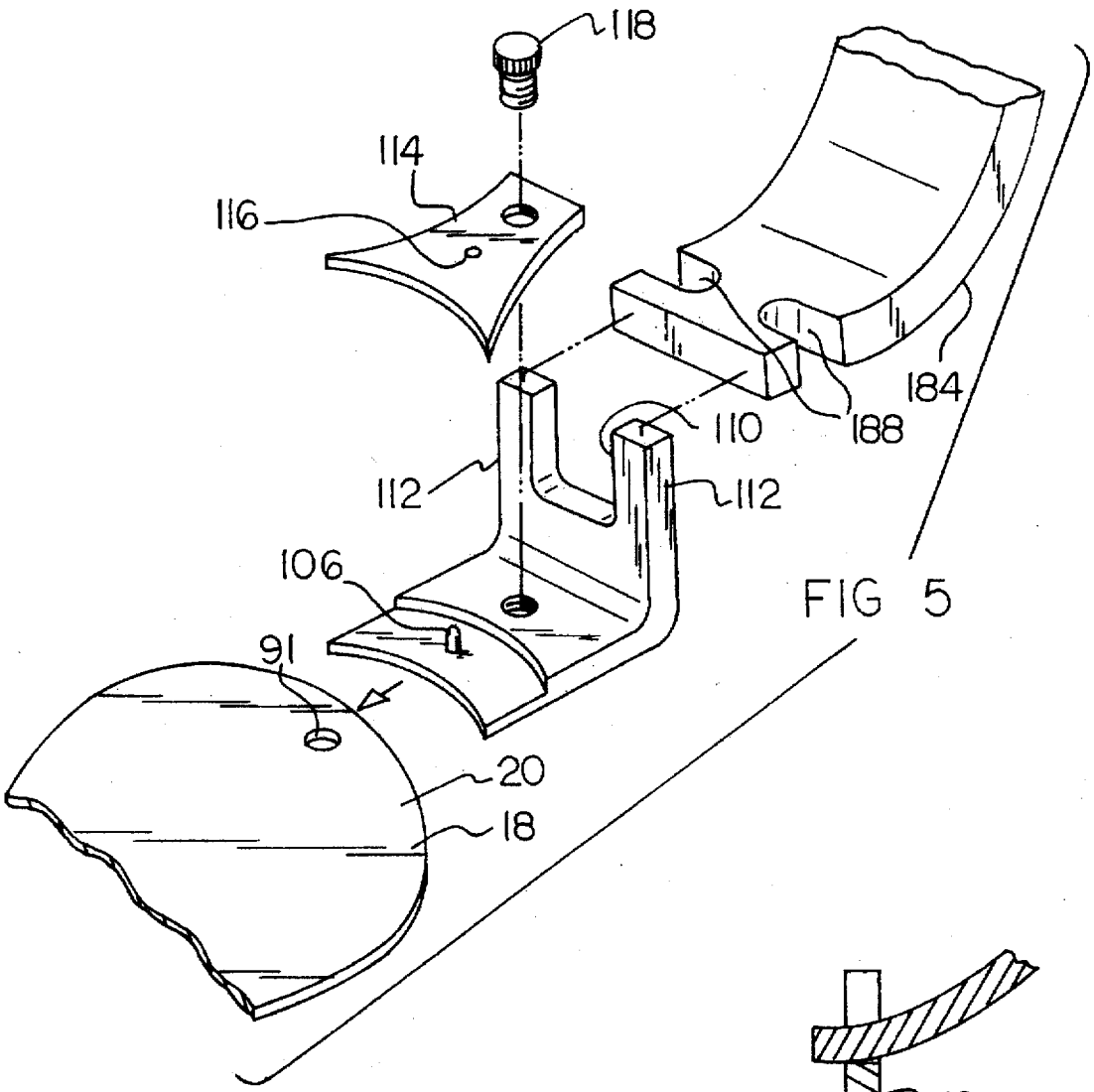
FIG. 5 is a perspective view of a portion of the tightening mechanism shown in FIG. 4.
Figure 6:
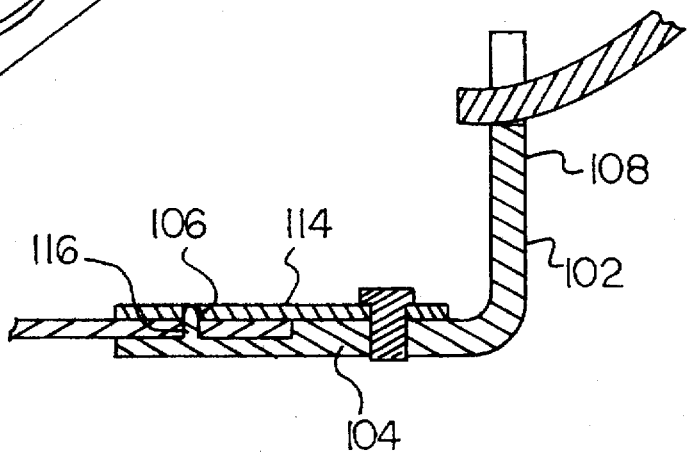
FIG. 6 is a cross-sectional view taken centrally through the apparatus shown in FIG. 4.
Figure 7:
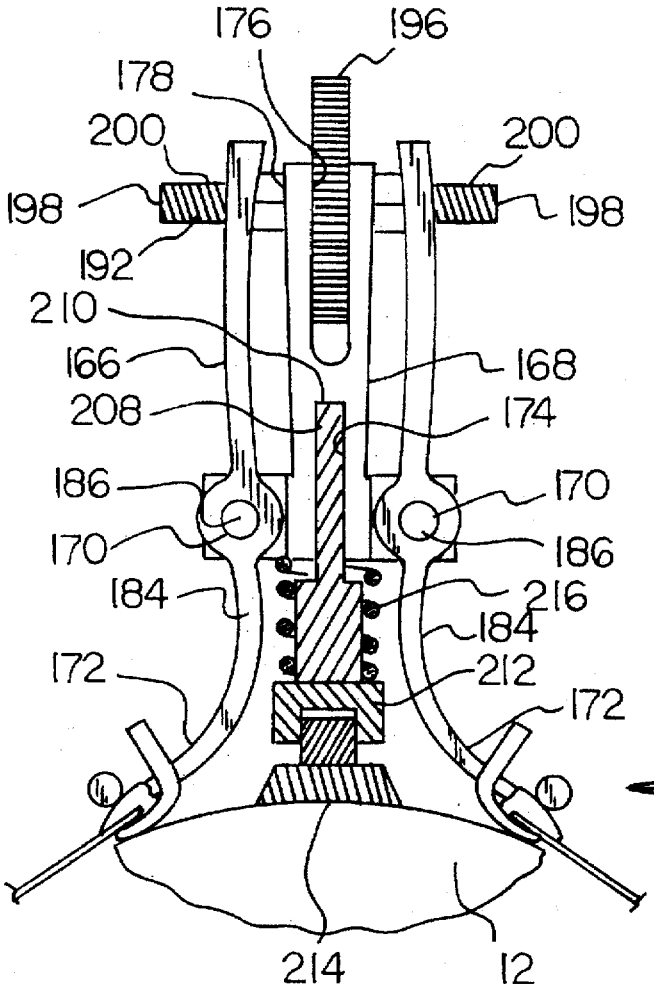
FIGS. 7 and 8 are front elevational views of the tightening mechanism in a relaxed state and a tensioned state.
Figure 8:
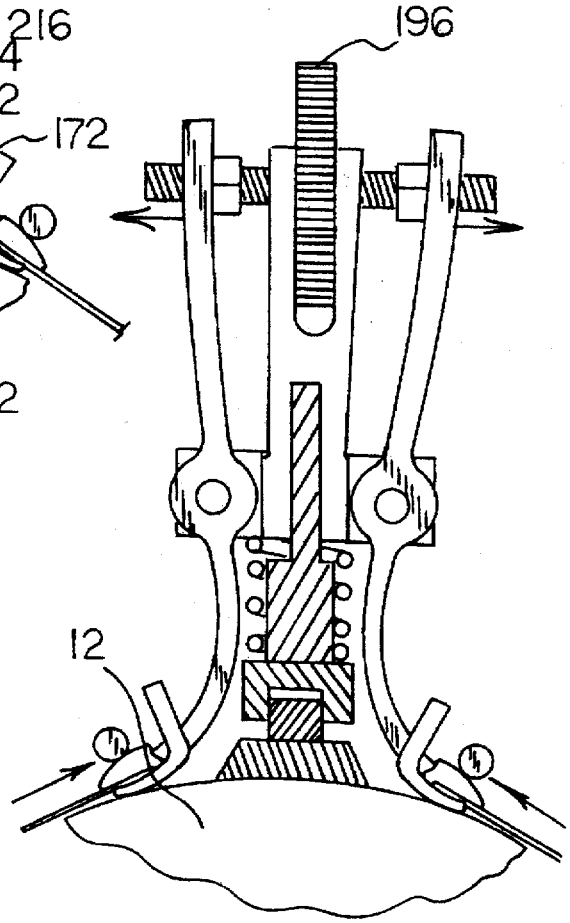
Figure 9:
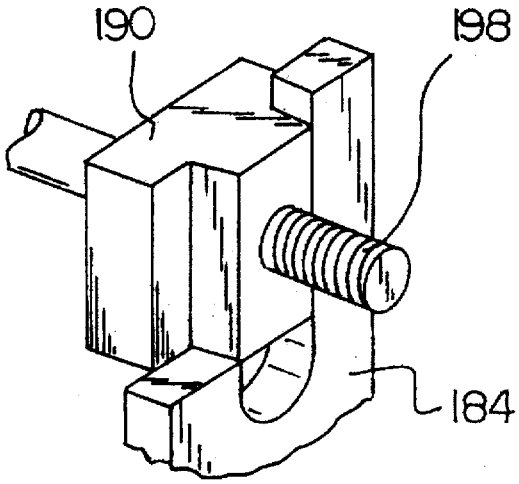
FIG. 9 is an enlarged perspective view of the upper end of one of the tightener arms.

The present invention is in a method and apparatus for the automated lacing of softballs, baseballs, and the like. In its broadest context, the invention may be considered as being carried out in three stages. The first stage is the preparation of two covers to be placed over one core. The second stage involves the clamping of the covers onto the core in proper orientation. The third stage involves the automatic movement of the core and cover through two cycles of operation, one to provide the lace holes if required and the other to lace the edges of the cover and thereby generate the final ball. The ball as used herein may be a conventional softball, baseball, or other ball where two cover panels are secured in proper orientation over a core.

THE BALL AND PANELS

The ball 10 in the preferred embodiment of the present invention is shown as a softball. Softballs, like smaller hard baseballs, are formed with a relatively rigid core 12 of a spherical configuration. The core construction may be a solid sphere, a hollow sphere of varying wall thickness, a filled sphere of varying walk thickness, a solid cork sphere or a wound filament cork sphere, the filaments normally being located over a small cork sphere.

Positioned over the core are a pair of similarly configured panels 18, 20. The panels are of essentially identical construction. The panels may be fabricated of a natural leather or, in the alternative, of a synthetic or composite material. When positioning a panel over the core, the panel must be stretched whereby its flat planar configuration will stretch and become generally spherical in shape for close conformity with the exterior surface of the core. In sizing the panels, it is normal to have synthetic or composite panels slightly larger than leather panels because leather panels normally stretch to a greater extent than synthetic or composite panels.

Each panel, prior to the covering of the core, is planar in configuration and has a first end section 26. Such end section has a peripheral end edge 28. Such peripheral end edge is in a generally semi-circular configuration which is convex. A second end section 30 also has a peripheral end edge 32 in a generally semi-circular convex configuration essentially identical to the first end edge.

Between the end sections is an intermediate section 38. The intermediate section is provided with a peripheral upper edge 40 and an opposed peripheral lower edge 42. The upper and lower edges each have a generally semi-circular concave configuration. Such upper and lower end edges are formed as an immediate continuation of the edges of the end section thereadjacent.

For a 12 inch softball, the radius of curvature A of each of the end sections is about 1.458 inches. The radius of curvature B of the intermediate section is about 6.625 inches. The radius of curvature of the edges of the intermediate section is thus about 4.544 times the radius of curvature of the edges of the end sections. The end sections are slightly greater than a semi-circle and constitute an angle C of about 227.75 degrees. The longest dimension of a panel measured along its longest central horizontal axis D is about 9.681 inches for a synthetic softball cover and about 9.460 inches for a leather softball cover which exhibits more stretch than a synthetic. The shortest dimension measured along its central vertical axis E is about 1.50 inches for a synthetic softball cover and about 1.532 inches for a leather softball cover. Other size softball and baseball covers are either proportionately larger or smaller.

Each of the panels is formed with lacing holes 48 and 50, preferably about 88 in number on the periphery of each panel. The lacing holes are adapted to receive a lace 46 which couples the panels together at their peripheral edges to secure it with respect to the core. The opposite lace ends are showing as dotted and dashed lines in FIG. 25.

As is conventional in the art, it is normal to provide a commercially available adhesive to the exterior surface of the core as well as to the interior surface of each panel prior to, the coupling therebetween. Such adhesive in combination with the laces hold the panels to the core in generating the final product, the ball 10. The final size of a softball could vary between nine inches and 16 inches in circumference. The final size of a baseball is proportionately smaller.

THE DIE

The cutting and piercing of the panels is effected through a die 52. The die, like the panels, has the shape of a dumbbell or dogbone as described above. The central portion of the die is a horizontally disposed and dumbbell-shaped planar plate 54. Such plate is fabricated of a hardened steel with a planar upper surface 56 for receiving the material to be cut and pierced. It also includes a lower surface 58 for positioning during the cutting and piercing operation.

The plate 54 is formed with a first end section 64 having a peripheral end edge 66 in a semi-circular convex configuration. A second end section 68 is also provided. Such second end section has a peripheral end edge 70, also in a generally semi-circular convex configuration essentially the same as that of the first end edge. Between the first and second end sections is an intermediate section 72. The intermediate section is provided with a peripheral first edge 74. It is also provided with an opposed peripheral second edge 76. The first and second edges each nave a generally semi-circular concave configuration. The ends of the edges of the intermediate section are formed as immediate continuations of the edges of the end section. The shape of the plate is essentially that of the panel to be cut.

Next provided as part of the die 52 is a continuous wall 82. The wall is formed as an upstanding projection vertically disposed with respect to the peripheral edges of the plate. At its end remote from the plate is a continuous cutting edge 84. Such cutting edge is at a predetermined common height from the plate. The cutting edge is adapted to cut material into the dumbbell-shaped panels.

Next provided as part of the die are four upstanding locator pins 90, 92. Such pins extend upwardly from the plate adjacent to the peripheral edges thereof. Two of the pins 90 are located on the horizontal center line of the plate. The other two pins 92 are located on the vertical center line of the plate. The pins are adapted to pierce material brought in contact therewith to form placement holes 91 and 93. The function of the holes 91 and 93 in the panels created by the pins will be described hereinafter.

The cutting edge of the wall has a height of between about ½ and ¾ inches from the plate. The pins have a height proportional to the height at the cutting edge wall. The pins have their greatest diameter adjacent to the plate. The plate is flat with no projections other than the locating pins as well as the peripheral continuous wall therearound.

In the operation and use of the die, the material to be cut is first placed on a generally rigid planar surface. The material of such surface is sufficient to allow limited deformation as caused by the force of the cutting edge of the peripheral wall and the point of the pins when pressed in contact therewith. The material of such surface, however, will reconfigure itself to its initial planar configuration after the removal of the cutting edge and pins.

With the materials to be cut, the die is placed thereabove with the cutting edge and pins in contact therewith facing downwardly. A ram of a press is located thereabove to urge the die downwardly into cutting contact to cut the material into the desired shape with the pin holes at the intended positions. The die is preferably physically separate from the ram of the press when leather or a synthetic/composite material is being cut since care must be taken to properly position the grain or weave of the material in a proper orientation with respect to the die for maximum strength of the panels on the final ball. The use of the die as described herein is generally conventional except for the configuration of the die. Such use and associated mechanisms are well described within the technical and patent literature.

Prior to considering the fabrication of the panels complete, a jaw 102 must be coupled with respect to the locating holes in the end sections of each panel. Each jaw is formed with a horizontal portion 104 positioned beneath the lower end edge of the panel on the interior surface of the panel when on the core. Each jaw, in addition to the horizontal portion, has an upwardly extending pin 106 centrally located on the horizontal portion. Such pin is positionable through a locating hole through a ball cover. In addition, each jaw has an upwardly extending fork 108 with a slot 110 between parallel legs 112. Each jaw also has a top jaw 114. Each top jaw has an aperture 116 for receiving the pin of its associated bottom jaw after passage through a locating aperture of the panel. In operation the cover panel's aperture is placed over pin 106, its edge 32 engaged with the arcuate recess in the top surface of the jaw. A thumb screw 118 then joins top jaw 114 to the jaw 102 orienting the jaw to the panel. The operation is repeated for the opposite end 28 of the panel. The purpose of the jaws will be described hereinafter.

CLAMPING SYSTEM

The second stage of the present invention is the clamping system wherein the cover panels are positioned over the core in proper orientation prior to lacing. The clamping system is adapted to hold the dumbbell-shaped panels of the ball in place in contact with the exterior surface of the spherical core prior to lacing the panels.

The clamping system 122 includes a pair of similarly-configured clamping assemblies 124. Each clamping assembly includes a pair of pads 126. The pads have interior surfaces 128 of a spherical configuration which are positionable on the widest part of the dumbbell-shaped panel when positioned on the core. This is to hold the panels against the core after they are located.

In addition to the pads, a lower plate 132 is also provided for each of the two clamping assemblies. Each lower plate has a longitudinal axis. It also has end apertures 134 and interior apertures 136. In association therewith, coupling the pads and lower plate, are two generally V-shaped links 138. The V-shaped links have first ends or upper ends 140. Such ends are adjustably secured to the pads at their exterior surfaces. Adjustment nuts 142, with male and female threaded members, allow for the adjustment between the links and pads. The V-shaped links also have second ends 144 pivotally connected through a pin to the interior apertures of the lower plate. Such is to effect rotational movement of the pads into and out of contact with the associated panel section of the ball. Motion of the links is preferably done manually.

Final retention of the V-shaped links in position is achieved through adjustable struts 150. Such struts have lower ends 152 pivotally coupled with the end apertures of the lower plate through pins 154. The struts have second or upper ends 156. Such struts are pivotable into contact with the links at shoulders 158 formed therein. When so positioned in contact with the shoulders, the V-shaped links are essentially locked with the pads in final position on the cover. Adjustment of the adjustable struts is effected through male and female threaded couplings 160 at an intermediate section of each strut. Two such clamping assemblies 124 are provided for each ball, one assembly for each panel.

As part of the clamping system there is also provided a cover-tightening mechanism 166. Note FIGS. 4–8. The cover-tightening mechanism is a single unit adapted to be utilized sequentially for tightening and positioning each panel of a ball. Such mechanism is formed with a central block 168. The central block has a pair of pivot apertures 170 at one end and a central vertical recess 174 at its lower extent. The block 168 also includes a slot 176 at its upper extent.

Next provided are a pair of tightener arms 184. Such tightener arms are of similar constructions. Each tightener arm is pivotally secured to the pivot apertures of the central block at a central extent of the arms through pins 186. Each tightener arm also has indents 188. The indents function for removable coupling with respect to the jaws 102 secured to the ends of the cover as described above. The indents receive the legs 112 of the fork 108 of the bottom jaw 102 at each cover end. Such coupling is at the lower ends 172 of the tightener arms. The upper end of each tightener arm 184 is slotted to hold a nut 190 which is threaded onto the spindle 198. Note FIG. 8. The face of the nut bearing against the tightener arm is radiused to eliminate cramping as the arm pivots during the clamping and unclamping motions.

Next provided as a component of the cover tightening mechanism is an actuating wheel 196. The actuating wheel is positioned in the slot of the central block. The actuating wheel has axially aligned spindles 198 extending from opposite sides through the center of the actuating wheel. The spindles are fixed to the wheel and are rotatable in the tightener arm nuts. The spindles have opposite threads 200 in threaded engagement with the threaded nuts on the tightener arms. In this manner, rotation of the actuating wheel in one direction or the other will function to expand and contract the upper ends of the tightener arms to thereby tighten and loosen a cover held by the cover tightener assemblies at the lower ends of the tightener arms.

As a part of the cover tightening mechanism, there is also a vertical post 208. The vertical post has an upper extent 210 reciprocally located in the recess of the central block. The vertical post also has a lower extent 212 with a spherical surface 214 positionable in contact with the upper portion of a ball to be covered. Such spherical surface is located between the cover tightening assemblies. In association therewith a coil spring 216 is located between the spherical surface and the central block to resiliently urge separation between the central block and a ball. In this manner, when the cover is tightened, the tightener arms will tend to move upwardly with respect to the ball and the fixedly positioned spherical surface. Appropriate tension between the ball and tightening mechanism is thus provided for effecting the intended tightening of the cover with respect to the core. The force of the spring is also resisted by a conical feature 126 centrally located on the top surface of the lower plate 132.

Figure 10:
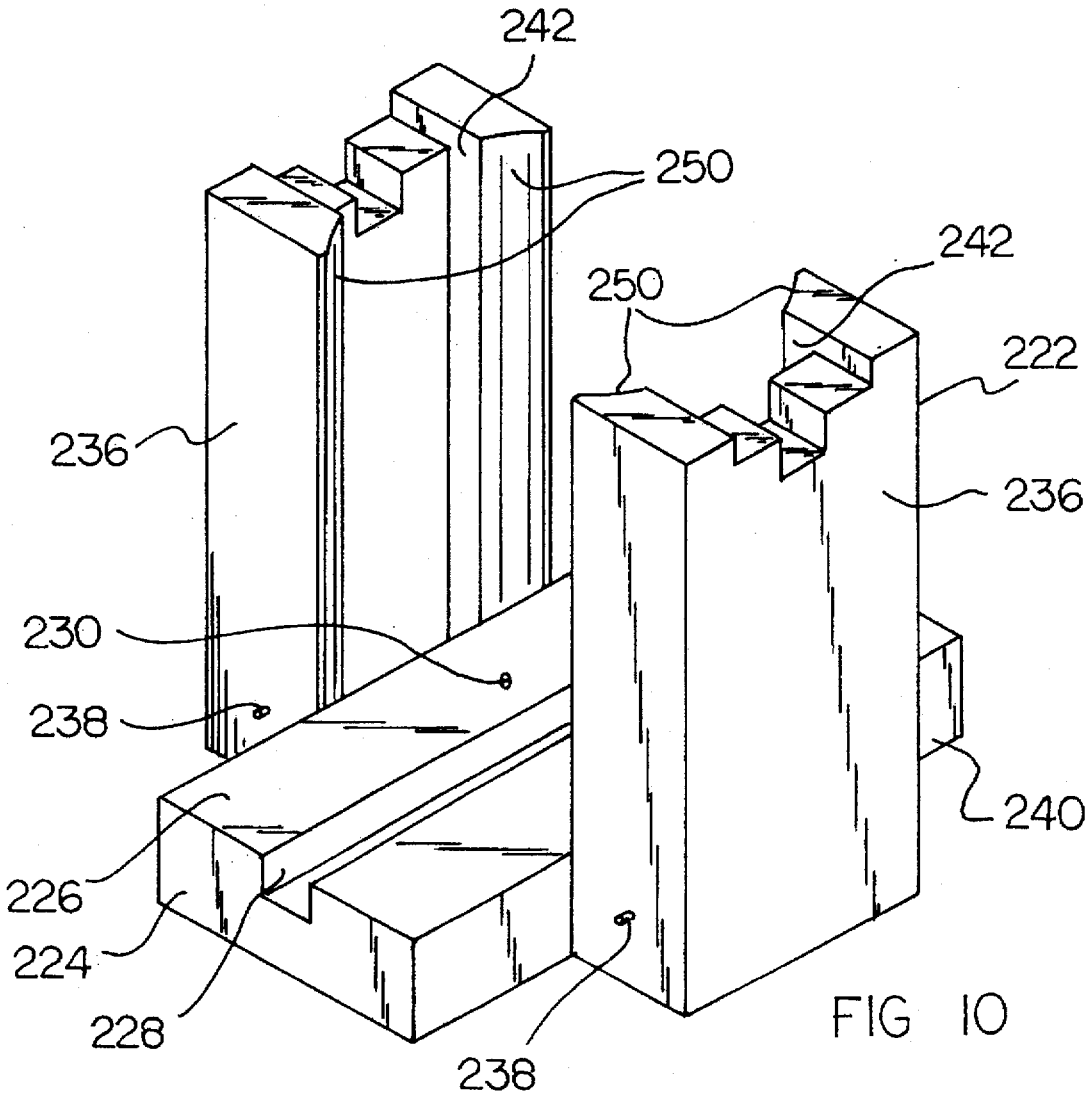
FIG. 10 is a perspective view of the lasting holder used in the fabrication process.
Figure 12:
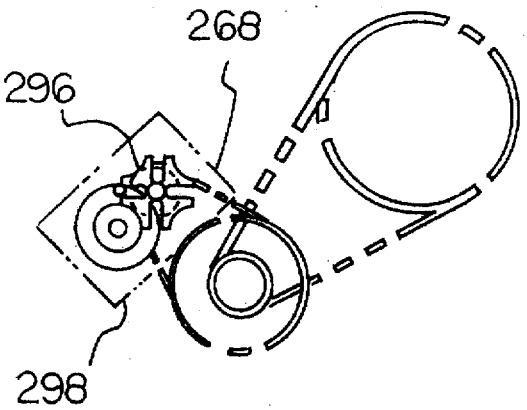
FIG. 12 is a front view of the indexing mechanism taken along line 12—12 of FIG. 11.

Also provided as a component of the clamping system is a lasting holder 222. Note FIG. 10. The lasting holder is a fixture for use during the fabrication process. It is actually used prior to the clamping assembly. Its function is to properly position the ball clamping assembly and cover with respect to each other so that the associated mechanisms may be properly utilized for generating a properly finished ball.

The lasting holder 222 includes a base 224. The base is formed with an upper horizontal surface 226 with a horizontal guide slot 228 formed into the upper surface and extending downwardly therefrom. The guide slot 228 is for receiving the lower plate 132 of a clamping assembly 124 as described above. The base is also formed with upwardly extending guide or locating pins 230 on opposite sides of the guide slot at a central extent of the base. The pins 230 are for receiving the central locating holes 293 of a cover to be tightened around a core.

In addition to the base 224, vertically extending side plates 236 are secured at their lower ends 238 to the sides 240 of the base at the central extent thereof. Such side plates 236 are located on opposite sides of the locator pins 230. The side plates are formed with interiorly facing recesses 242.

The interiorly facing recesses 242 have symmetrically located guide surfaces 250. Such guide surfaces are for receiving and locating the core of an unlasted ball, so as it may be properly positioned centrally above the central extent of the cover. This is prior to the movement of the cover into proper position on the ball for being tightened by the cover tightening mechanism 166 and then clamped by a clamping assembly 124. In the preferred embodiment, two such bases are provided of essentially identical construction except for the sizes of the interior facing recesses. On the second tool, to be used after the second tool, the interiorly facing recesses have guide surfaces 250 which are particularly sized for receiving and locating the cover of a partially lasted ball. By partially lasted ball it is meant a ball with one cover in position and secured thereto by a first clamping assembly.

INDEXING APPARATUS

After a core has been properly provided with cover panels held in place by the clamping assemblies, it is next moved to a ball-indexing drive 256. The ball-indexing drive is a machine for supporting and moving a core with a lasted cover to be punched and laced. The movement of the core with a lasted cover is in a path of motion wherein the line of lacing on the cover will sequentially index through a specific single point in space throughout the entire movement of the lasted core.

Figure 11:
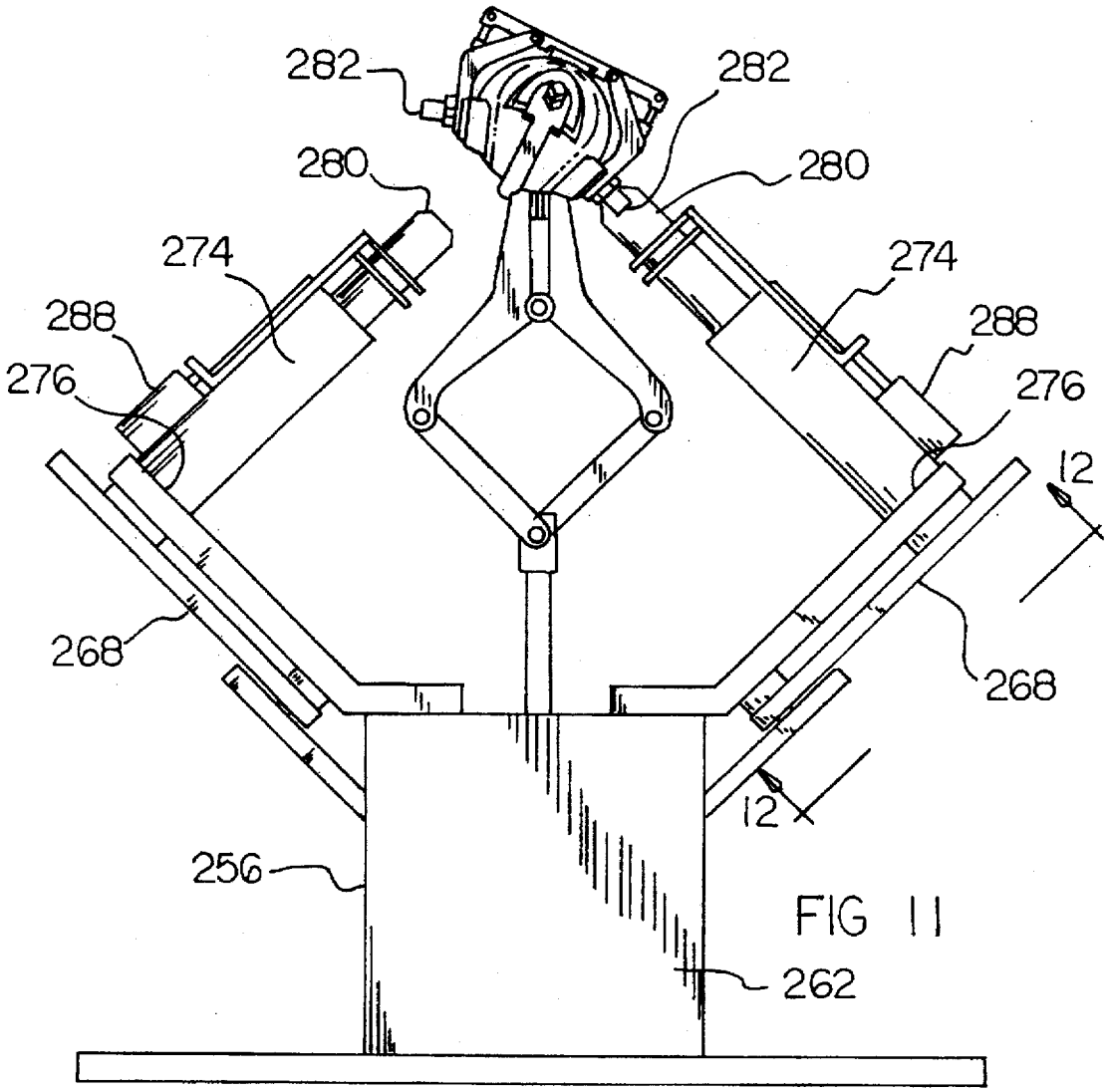
FIG. 11 is a front elevational view of the indexing mechanism.
Figures 13, 14, 15, 16:
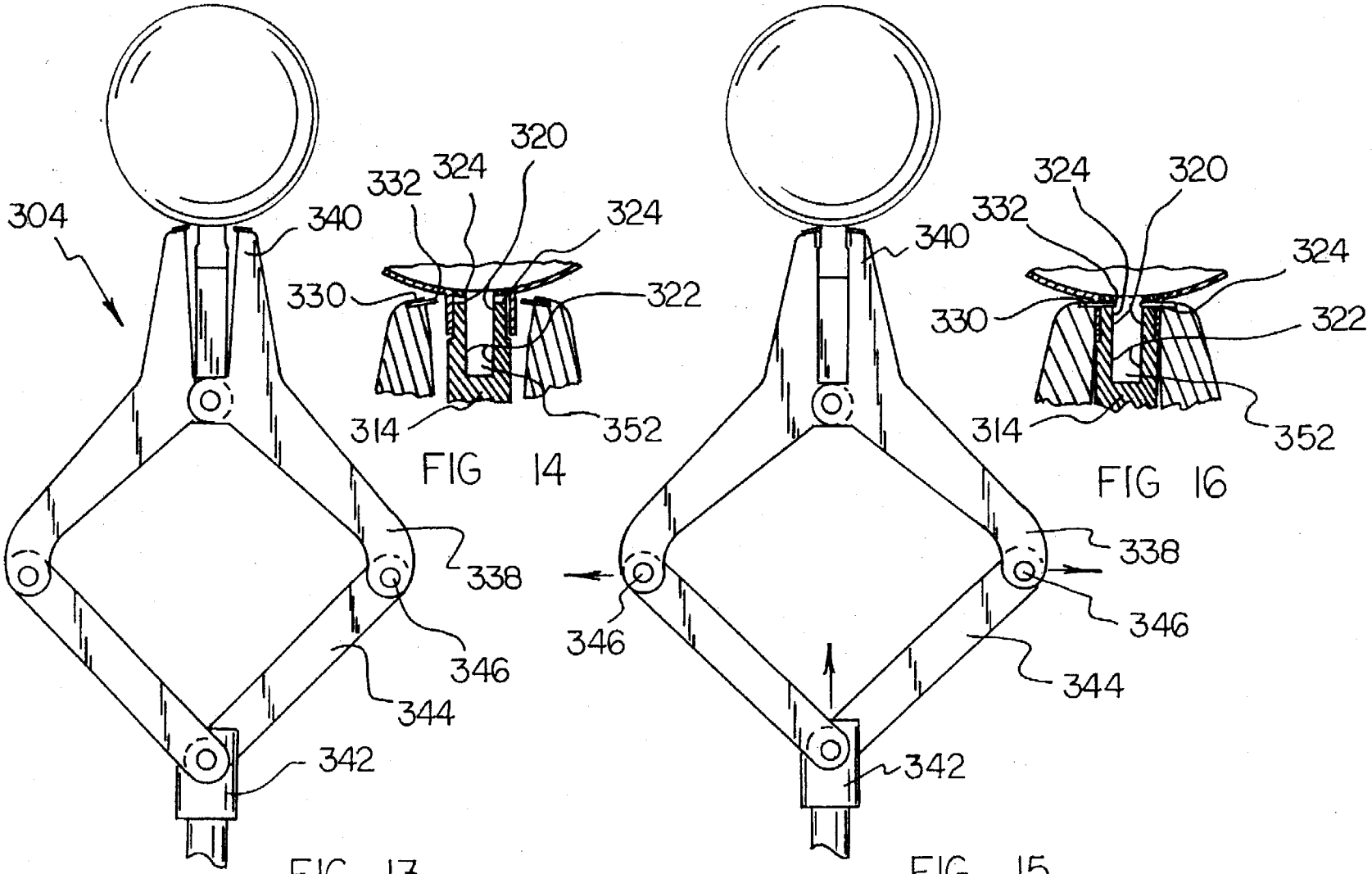
FIGS. 13, 14, 15 and 16 are front elevational views of the hole punching apparatus.
Figure 17:
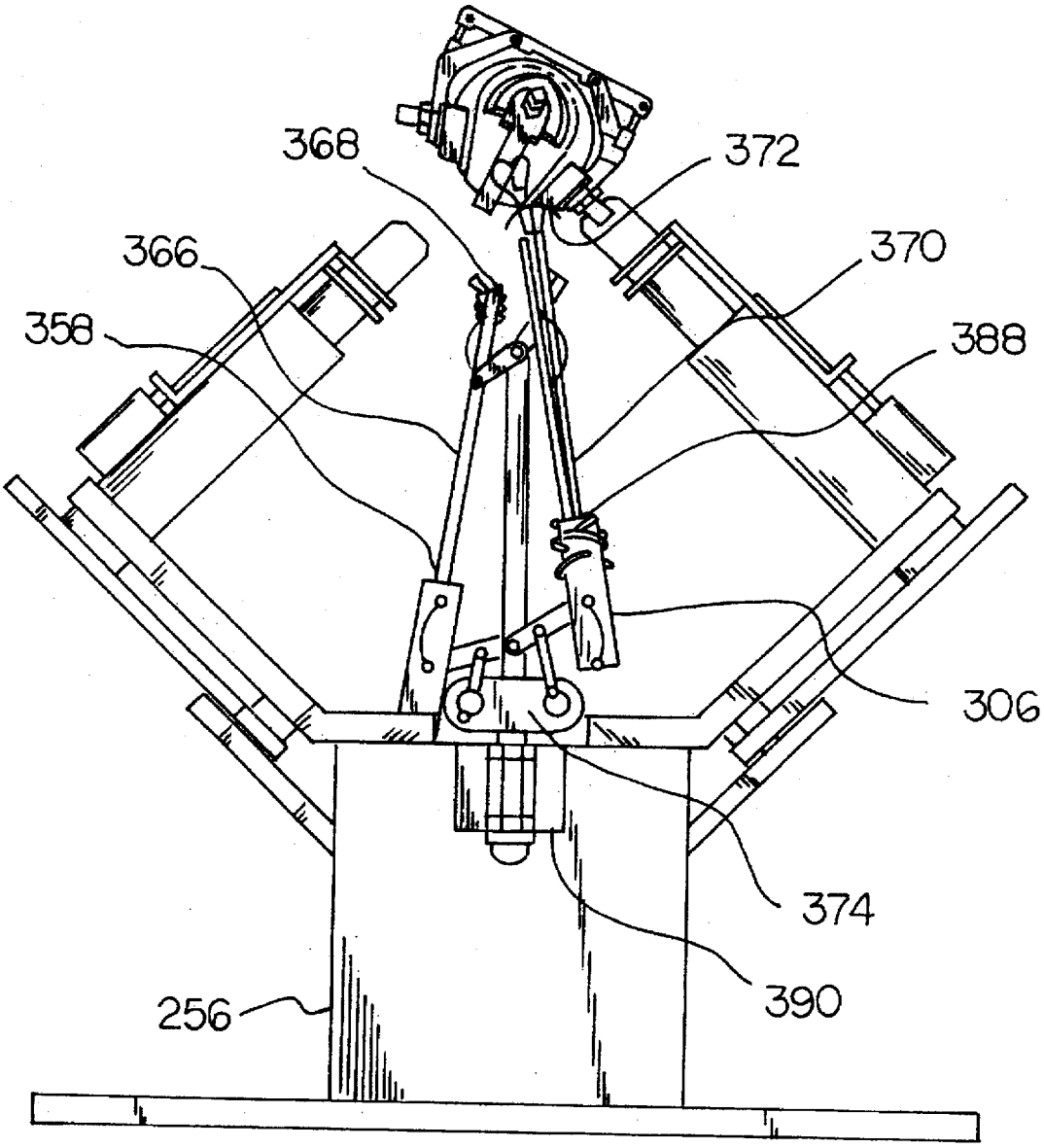
FIG. 17 is a front elevational view of the indexing mechanism with the lacing apparatus included.
Figures 18, 19, 20:
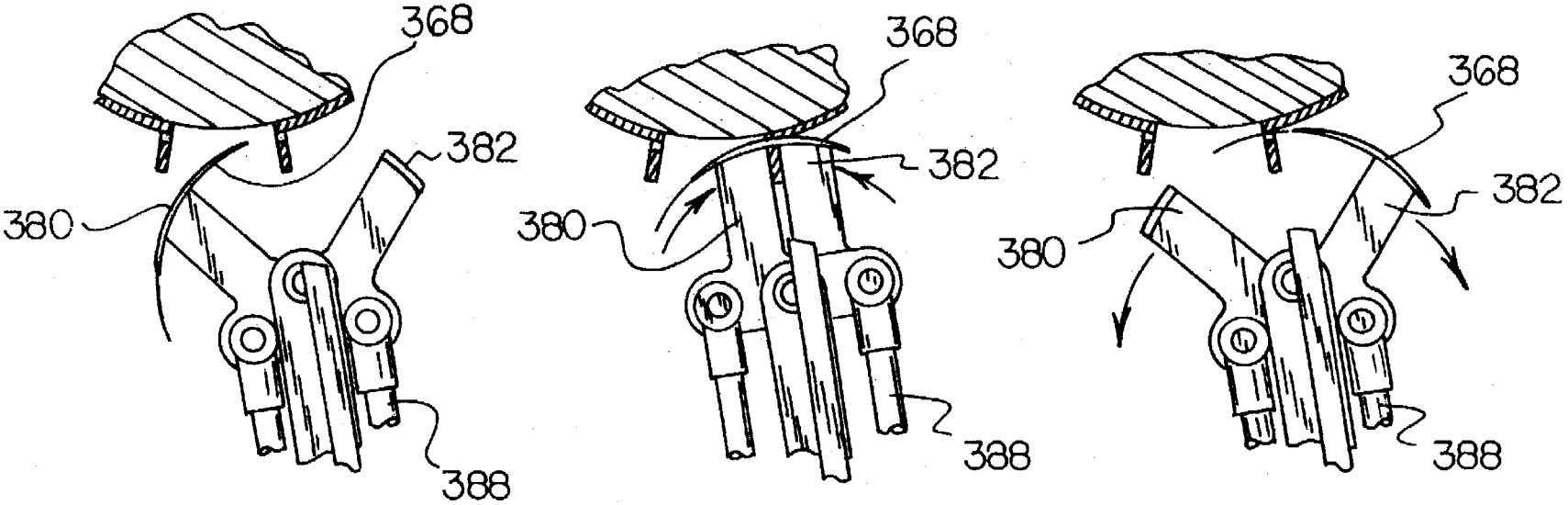
Figure 23:
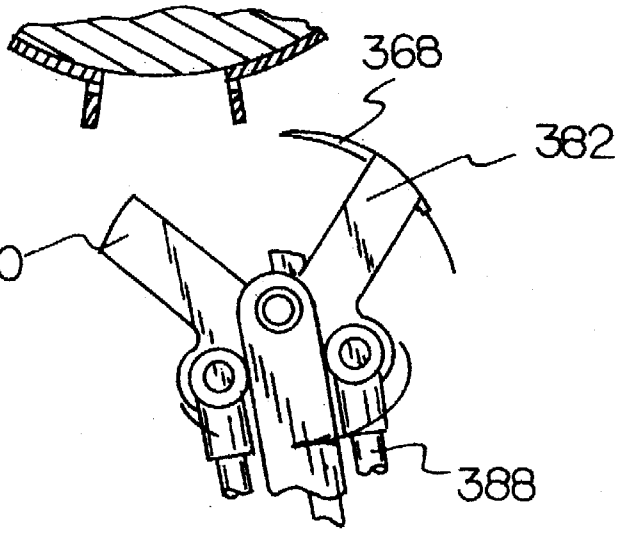
Figure 22:
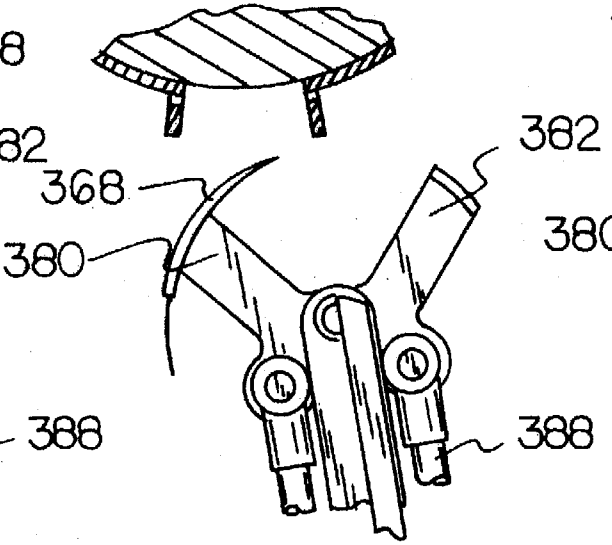
Figure 21:
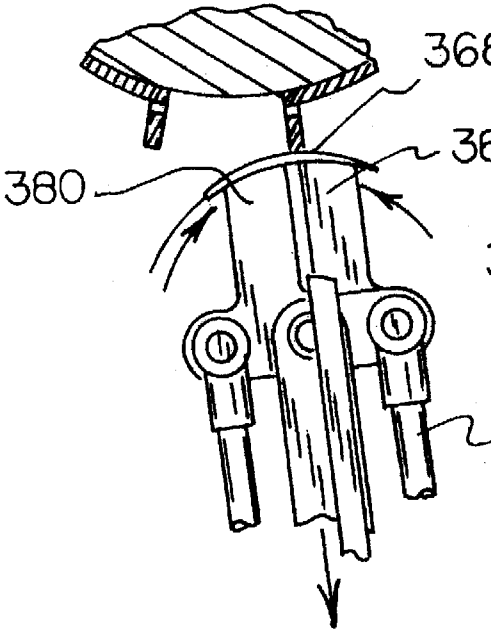

A next component of the ball-indexing drive is a drive box 262. Note FIG. 11. The drive box includes conventional mechanical power generating mechanisms. It is mounted on a recipient surface such as a work table or floor. The drive box has a central vertical axis extending upwardly therefrom. The axis of the drive box extends upwardly through the center of the core with a lasted cover to be punched and laced.

Next provided as part of the ball-indexing drive is a pair of indexing drives 268 of similar construction. Such drives are mounted on the drive box. Each drive extends upwardly and outwardly at about 45 degrees from the vertical axis of the drive box. This constitutes an angle of about 90 degrees between the two indexing drives.

Next provided as part of the ball-indexing drive is a pair of support arms 274. Each support arm is coupled at its lower end 276 to an associated indexing drive 268. Each support arm has an upper end 280 adapted to receive and support an axially aligned lug 282, one for each pad of the clamping assemblies. Each lug extends radially with respect to the ball to a distance radially exterior of the pad for being grasped by the support arm. This relationship allows the rotation of the support arm about its axis. When so rotated, the ball will move the line of lacing between adjacent cover peripheries for an operational cycle. Such motion will also bring the next adjacent drive lug into axial alignment with the other indexing drive.

A piston 288 is provided for each support arm. Each piston is adapted to move the upper end of one support arm forwardly for grasping and rotating an associated drive lug. The piston is then effected to move the upper end of the support arm rearwardly away from its associated lug after the other support arm has moved forwardly to grasp another drive lug for the rotation thereof.

A constantly rotating motor 298 and an associated Geneva or like mechanism 296 associated therewith is located on each indexing drive. The Geneva mechanism functions in the conventional manner to convert a constant rotational input into a rotating step and repeat output. Such mechanisms with their constantly rotating drive motor 298, functioning through its Geneva mechanism, will thereby function to rotate a support arm about its axis in a step and repeat manner. This imparts rotational motion to a supported softball through four equally divided movements, the first four 180 degree movements are for first punching while the second four 180 degree movements are for lacing the softball.

In association with the ball indexing drive are two additional assemblies. The first is an apparatus 304 for punching the lacing holes and an apparatus 306 for lacing the cover panels. Such components are usable with a common ball indexing drive. Such two apparatus 304 and 306 may be taken out and replaced on the indexing drive one with respect to the other during operation and use. It is preferred, however, to have a plurality of ball indexing drives, some with the apparatus for punching lacing holes and some for the lace threading of the covers. The numbers of each unit is correlated with the speed of operation of each for maximum efficiency and usage of such equipment in systems configurations.

PUNCHING APPARATUS

The apparatus 304 for punching lacing holes through the periphery of a pair of ball panels lasted on a core of a ball comprises, as a central component, a fixedly positioned plow 314. The plow is an upper surface of a fixedly positioned member located to be slidingly contacted by the out-turned peripheral edges of adjacent covers of a ball to be punched. Note FIGS. 13–16. The plow extends radially with respect to the ball and tangentially with respect to the cover. It is at 90 degrees with respect to the direction of movement of a line between adjacent edges of the panels moved in contact with the plow.

The plow is formed with axially aligned holes 320. Such holes are formed in the opposite faces 322 of the plow. It is across these opposed faces and holes against which the edges of the covers slide. The holes have external edges 324 constituting cutting dies for the punching operation.

Next provided as components of the punching apparatus are associated cylindrical punches 330. The punches are of such size as to be movable at their exterior ends 332 into the holes of the plow. The punches are movable into and out of the holes of the plow when the peripheries of the panel to be punched are located therebetween.

A toggle mechanism 338 is next provided. The toggle mechanism is formed with oscillatory upper ends 340. Such upper ends support the punches 330. The toggle mechanism has reciprocal lower ends 342 for being driven. Intermediate links 344 with pins 346 effect the reciprocation between the upper and lower ends.

Coupled with respect to the lower ends of the toggle mechanism is a drive. Such drive may be automatic or effected by hand. In this manner, vertical reciprocation of the drive will move the punches through the peripheries of the panels into the holes of the die. This action forms mating lacing apertures along the continuous periphery of the panels.

In the preferred embodiment of the invention, a vertically extending aperture 352 is located down the center of the die. In association therewith a vacuum may be withdrawn. Such an arrangement allows for the drawing away of swarf, the material cut from the panels during the punching operation.

LACING APPARATUS

The last component of the system is the lace threading apparatus 306. As part of the lace threading apparatus, a first threading mechanism 366 is provided with a first needle 368. Such needle is positioned at the upper end of the threading mechanism. In addition a second threading mechanism 370 is provided with a second needle 372. Such second needle 372 is positioned at the upper end of the second threading mechanism. In association therewith a common reciprocator 374 is located adjacent to the lower ends of the threading mechanisms. Such reciprocator functions to reciprocate each threading mechanism upwardly and downwardly along its respective axis in sequence. This will alternately bring the needles adjacent to the lacing zone. At no time are the two needles concurrently within the lacing zone.

In association with each needle is a pair of grippers 380, 382. One gripper functions to grasp each needle while it passes through a lacing aperture of the panels. The first gripper then releases its associated needle after it is passed through one associated panel aperture whereat it is grasped by its associated gripper in anticipation of a next passage.

The grippers are at the upper ends of each threading mechanism and include an associated drive 388. In this manner, each needle may be rotated in an arcuate path through an associated lace hole with the needles acting sequentially in alternate fashion. In addition, at the lower end of the two threading mechanisms is an oscillating drive 390. Such drive functions to reciprocate the threading mechanisms concurrently about a vertical axis of rotation. In this manner, the needles may be rotated and then moved through the next adjacent lace hole in a direction opposite from the first direction.

TAKE-UP MECHANISM

Shown in FIGS. 26 and 27 is an indexing apparatus with an associated take-up mechanism 394. Such take-up mechanism is generally conventional and is provided with two arms 396 adapted to contact the ends of the lace adjacent to the needles and to hold them taut so that the needles may move the ends of the lace material through the lacing apertures without entangling with other regions of the lace.

METHOD

The method of the present invention is directed to a method of fabricating a ball. It comprises a plurality of steps. Such steps include first providing a spherical core and providing a pair of dumbbell-shaped panels as described above with convex end edges and a concave central extent therebetween. Next provided is a first clamping assembly and then provided is a first lasting holder. The method includes positioning into the first lasting holder a first clamp assembly, the first panel and a first core. The clamping jaws are applied to the panels prior to their being loaded into the holder. The pins on the lasting holder ensure the proper positioning of the cover above the clamping assembly. The recesses in the sides of the lasting holder, ensure the proper positioning of the unlasted ball thereon.

The next step involves the shaping of the first panel around a first portion of the core followed by the clamping of the first panel in position with the first clamping assembly.

The next step involves providing a second lasting holder and positioning therein a second clamping mechanism followed by a second panel and the partially lasted core. Such second lasting holder is essentially the same in construction as the first lasting holder 222 as described above. Note FIG. 10. Thereafter, the method includes shaping the second panel around the remainder of the partially lasted core followed by clamping the second panel in position on the core. Such shaping and clamping of the second panel is essentially the same as the shaping and clamping of the first panel as described above.

The method then involves providing an indexing drive with two support arms. Each support arm is adapted to receive and support a portion of a clamping assembly. The next step involves grasping a portion of the first clamping assembly by the first support arm followed by rotating one indexing drive, support arm, clamping assembly and supported core. In this manner, one-fourth of the line between adjacent panels will move through one specific operational zone, a particular point in space.

The next step involves punching lacing holes through the panels adjacent to their peripheries as they move through the operational zone.

The next step involves grasping a portion of the second clamping assembly by the support arm and then releasing the first portion of the first clamping assembly by the first support arm. This is followed by rotating the second indexing drive, support arm, clamping assembly and supported core. In this manner, another one-fourth of the line between adjacent panels will move through the operational zone. This occurs while punching lacing holes through the panels adjacent to their peripheries as they move through the operational zone. These steps of grasping, rotating, punching followed by the second grasping, rotating and punching are then repeated to thereby punch lacing holes in the entire lasted core.

The next step involves grasping a portion of the first clamping assembly by the first support arm followed by rotating one indexing drive, support arm, clamping assembly and supported lasted core. In this manner, one-fourth of the line between adjacent panels will again move through the operational zone. It has been found that the initial placing of the lacing material into the first pair of holes is preferably done by hand. The next step involves moving lacing through the holes as the holes move through the operational zone.

The next step involves grasping a portion of the second clamping assembly by the second support arm and releasing the first portion of the first clamping assembly by the first support arm. This is followed by rotating the second indexing drive, support arm, clamping assembly and supported core. In this manner, another one-fourth of the line between adjacent panels will again move through the operational zone. The next step is moving lacing through the holes as they move through the operational zone.

The next step involves repeating the steps of grasping, rotating, moving and the subsequent grasping, rotating and moving to thereby move lacing through the holes in essentially the entire lasted core. The final movement of lacing through the final holes is preferably done by hand. An alternate method of fabricating the ball is to punch/lace through the same four rotational movements.

The present disclosure includes that contained in the appended claims as well as that of the foregoing description.

Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

Now that the invention has been described,

What is claimed is:

1. A softball comprising:

a spherical core;

a pair of similarly configured leather panels covering the core, each panel, prior to covering the core, comprising a first end section having a peripheral end edge in a generally semicircular convex configuration, a second end section having a peripheral end edge in a generally semicircular convex configuration, and an intermediate section with a peripheral upper edge and an opposed peripheral lower edge, the upper and lower edges each having a generally semicircular concave configuration and located as an immediate continuation of the edges of the end sections, the radius of curvature of the end edges of each of the end sections being about 1.458 inches, the radius of curvature of the upper and lower edges of the intermediate section being about 6.625 inches, with the end sections constituting about 227.75 degrees; and laces coupling the panels to the core.

2. A panel for use in covering the core of a spherical ball comprising:

a first end section having a peripheral end edge in a generally semicircular convex configuration;

a second end section having a peripheral end edge in a generally semicircular convex configuration, the first and second end sections having a first radius of curvature; and and intermediate section with a peripheral first edge and an opposed peripheral second edge, the first and second edges having a generally semicircular concave configuration with a second radius of curvature and located as an immediate continuation of the edges of the end sections, the second radius of curvature being about 4.544 times the first radius of curvature.

3. The panel as set forth in claim 2 and further including a plurality of apertures extending therethrough to assist in positioning a panel upon a stitching machine.

* * * * *